United States Patent [19]

Hager

[11] Patent Number: 5,040,671

[45] Date of Patent: Aug. 20, 1991

[54] PROTECTIVE CASE FOR COLLECTIBLE FLAT ITEMS

[76] Inventor: Alan C. Hager, 251 Main St., Suite 307, Stamford, Conn. 06903

[21] Appl. No.: 628,616

[22] Filed: Dec. 17, 1990

Related U.S. Application Data

[63] Continuation-in-part of Ser. No. 468,052, Jan. 22, 1990, Pat. No. 4,979,619.

[51] Int. Cl.[5] ..... A45C 11/14; B65D 85/62; G09F 3/18

[52] U.S. Cl. ..... 206/39; 40/661; 40/158.1; 40/156; 206/509; 206/45.34

[58] Field of Search ..... 206/509, 508, 503, 39, 206/449, 45.31, 45.34; 150/145, 147; 40/661, 158.1, 156, 154

[56] References Cited

U.S. PATENT DOCUMENTS

| | | | |
|---|---|---|---|
| 896,753 | 8/1908 | Peterson | 40/156 |
| 2,124,143 | 7/1938 | Long | 40/661 X |
| 2,294,796 | 9/1942 | Moulder | 40/661 X |
| 3,034,640 | 5/1962 | Evans | 206/45.34 |
| 3,255,870 | 6/1966 | Peck | 206/45.34 |
| 3,877,162 | 4/1975 | Wilson | 40/661 |
| 4,518,080 | 5/1985 | Ohlson | 40/156 X |
| 4,545,486 | 10/1985 | Bostic | 206/45.34 |
| 4,736,538 | 4/1988 | Pierce et al. | 40/156 X |

FOREIGN PATENT DOCUMENTS

| | | | |
|---|---|---|---|
| 3110129 | 11/1981 | Fed. Rep. of Germany | 206/45.31 |

*Primary Examiner*—William I. Price
*Attorney, Agent, or Firm*—Norman B. Rainer

[57] ABSTRACT

A transparent plastic case is provided for the protective long term storage of flat collectible items. The case is comprised of first and second panels of matching elongated rectangular perimeter adapted to be cohesively sealed to enclose a collectible item disposed in a transparent retainer, and a documentation card. The dimensions of the case relative to the retainer are such that the collectible item within a sealed case is not tightly pressed against the retainer. The panels are further configured to facilitate stacking of a number of the cases.

10 Claims, 3 Drawing Sheets

PROTECTIVE CASE FOR COLLECTIBLE FLAT ITEMS

This application is a continuation-in-part of application Ser. No. 07/468,052 filed 01/22/90, now Pat. No. 4,979,619.

BACKGROUND OF THE INVENTION

This invention relates to the protective long term storage of flat collectible items, and more particularly concerns a protective case for the storage of rare postage stamps and paper currency.

U.S. patent application Ser. No. 07/468,052, filed 01/22/90 describes a plastic holder case, constructed of two halves, for protectively securing and authenticating sports cards such as baseball cards. The holder has a specialized design whereby the enclosed card disposed in a first holding zone, is not squeezed into contact with the plastic holder, but is instead movable within the holder. This feature prevents the sticking of the card to the plastic during long term archival storage. A second holding zone within the holder accommodates documentary indicia. The two halves of the holder are cohesively bonded together, preferably by sonic welding techniques to encapsulate the enclosed card. Such cohesive bonding method avoids the use of solvent-based adhesives whose solvents could adversely affect the card during long term storage. To further enhance archival storage characteristics, the halves of the case are swept with an inert gas or are disposed in a vacuum chamber during the bonding process. This prevents the retention of any aggressive gaseous species within the sealed holder case.

The aforesaid plastic holder case would appear to be well suited for retaining other valuable flat items, where the sealed nature of the case would desirably protect the item and provide authentication. However, it has been found that, in the case of postage stamps, paper currency, and other thin, light-weight articles, the sweeping gas movement or sonic vibration during the sealing process causes the article to "float" out of the holder during the bonding process.

It is accordingly an object of the present invention to provide a transparent case for flat, light-weight collectible items.

It is another object of this invention to provide a case as in the foregoing object adapted for sealing by cohesive bonding techniques.

It is a further object of the present invention to provide a case of the aforesaid nature which prevents movement of said light-weight item by gaseous current during said cohesive bonding.

It is a further object of the present invention to provide a case of the aforesaid nature which is stackable with other cases of the same construction.

It is a still another object of this invention to provide a case of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a case for protectively confining collectible flat items. comprised of:

(a) a first or front panel fabricated of transparent plastic and having: (1) an elongated rectangular perimeter defined by upper and lower short edges and long side edges, (2) an outer face having a first upraised ridge of rectangular contour disposed adjacent said perimeter and uniformly spaced therefrom by a margin region, and (3) an interior face having an upraised lip formed as a continuous integral extension of said edges and directed in opposite relationship to said first ridge, and (b) a second or rear panel fabricated of transparent plastic and having: (1) an elongated rectangular perimeter identical to the perimeter of said first panel and defined by upper and lower short edges and long side edges, (2) an outer face having a second upraised ridge contiguous to said perimeter and of a rectangular contour slightly larger than the rectangular contour of said first upraised ridge, and (3) an interior face having upraised portions uniformly spaced from said edges and defining a first rectangular holding zone for accommodating a flat collectible item and having an axis of elongation perpendicular to said short edges, and a second holding zone adjacent said upper short edge, whereby (c) when the interior faces of the front and rear panels are brought into facing relationship, the upraised lip of said front panel snugly embraces the upraised portions of said rear panel, and permits cohesive interbonding of the edges of both panels, and (d) thin transparent retainer means removably disposed within said first holding zone.

In a preferred embodiment, the second rectangular holding zone has an axis of elongation perpendicular to said side edges.

The present invention is based in part upon the discovery that fixed contact of the collectible item with the plastic of the case must be avoided in order to prevent long term damage of the item. Accordingly, the distance of separation of the interior faces of the interbonded panels, and the dimensions of the first holding zone are such as to permit some sliding movement of the collectible item in the sealed case. The invention is also based in part upon the discovery that, unless retaining means are utilized, a light-weight collectible item will migrate from its desired position of encapsulation by virtue of gas currents or sonic vibrations generated during cohesive interbonding of the panels.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
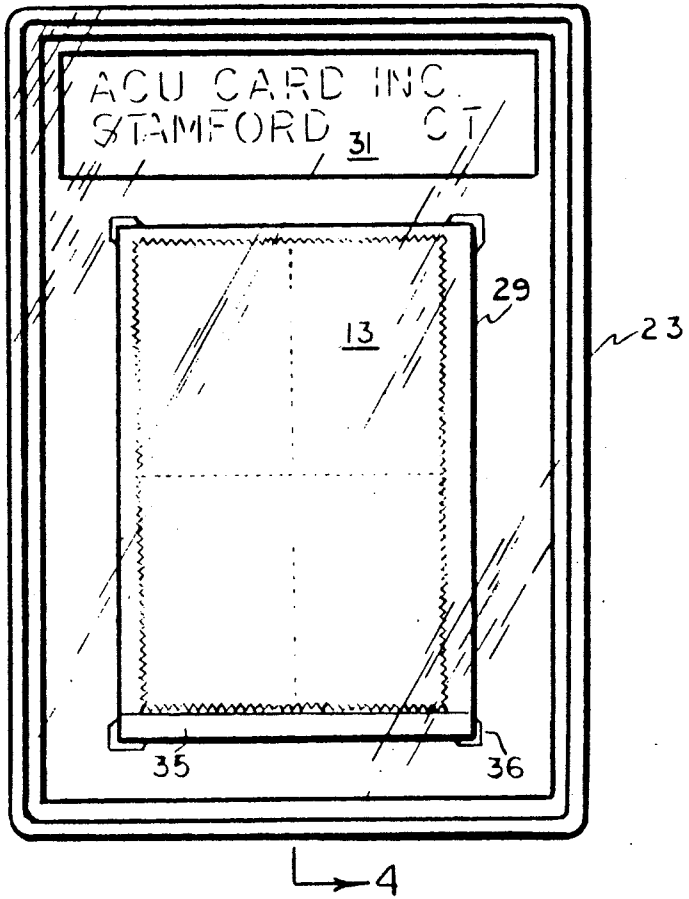
FIG. 2 is a rear view of the case of FIG. 1.
Figure 1:
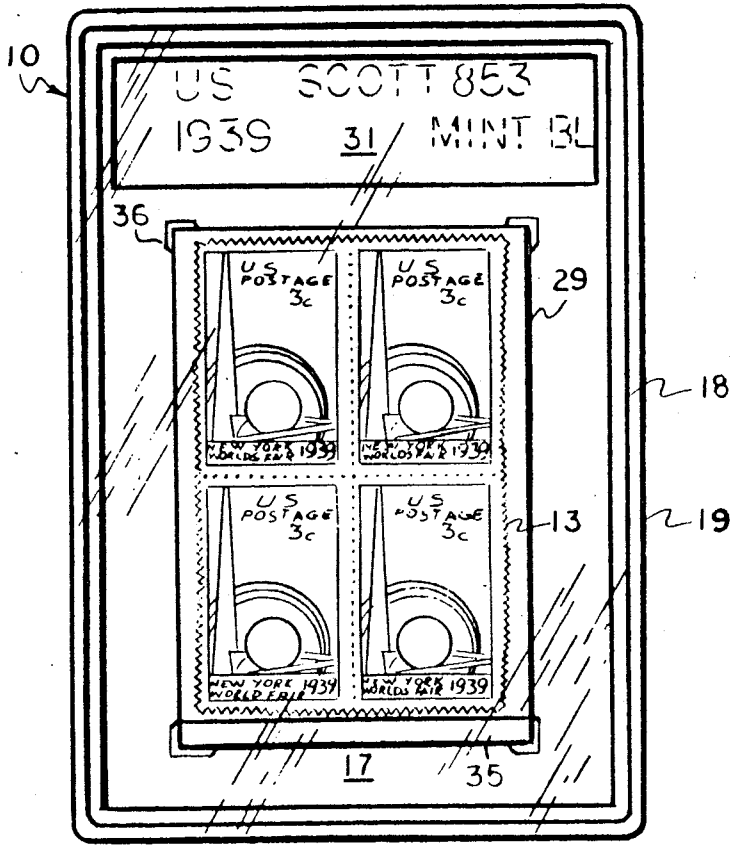
FIG. 1 is a front view of an embodiment of the case of this invention shown functionally engaging a block of four postage stamps.
Figure 3:
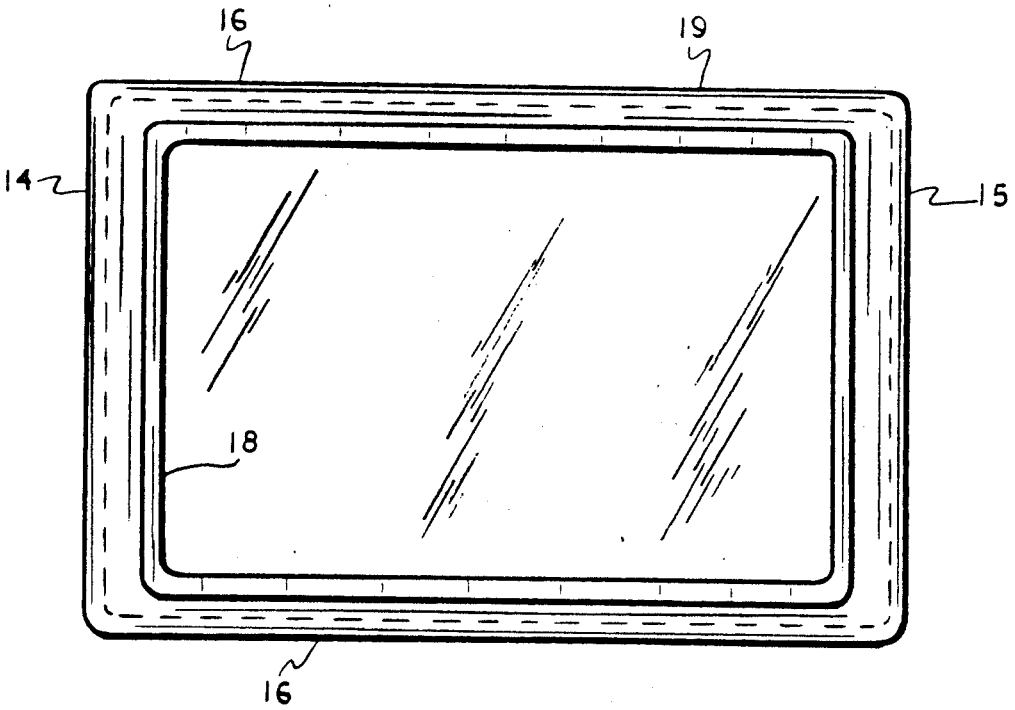
FIG. 3 is a plan view of the outside face of the front panel component of the case of FIG. 1.
Figure 4:
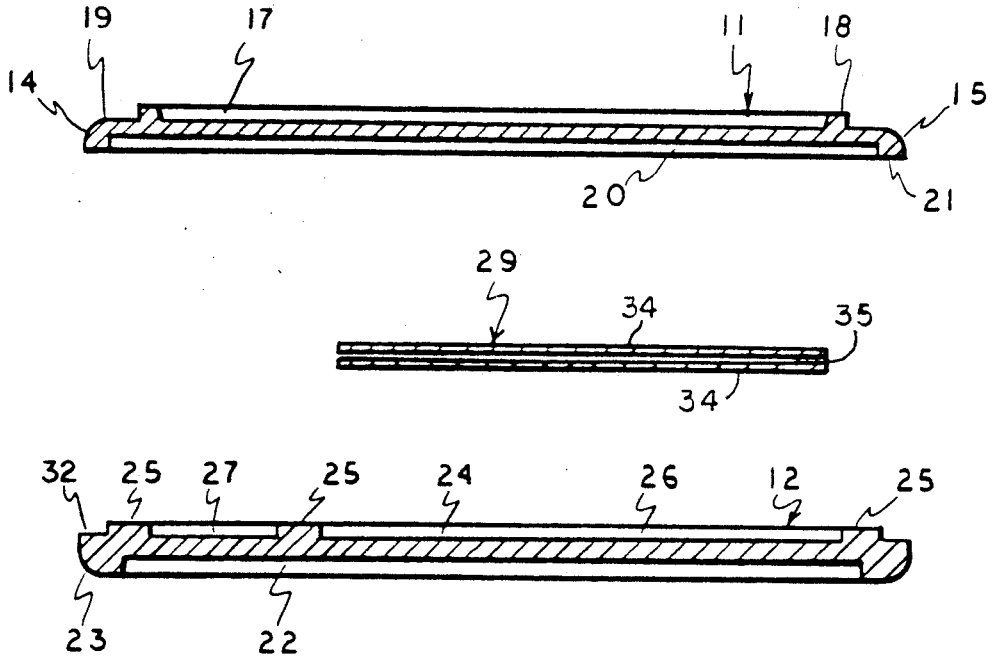
FIG. 4 is an exploded sectional view taken upon the line 4—4 of FIG. 2.
Figure 5:
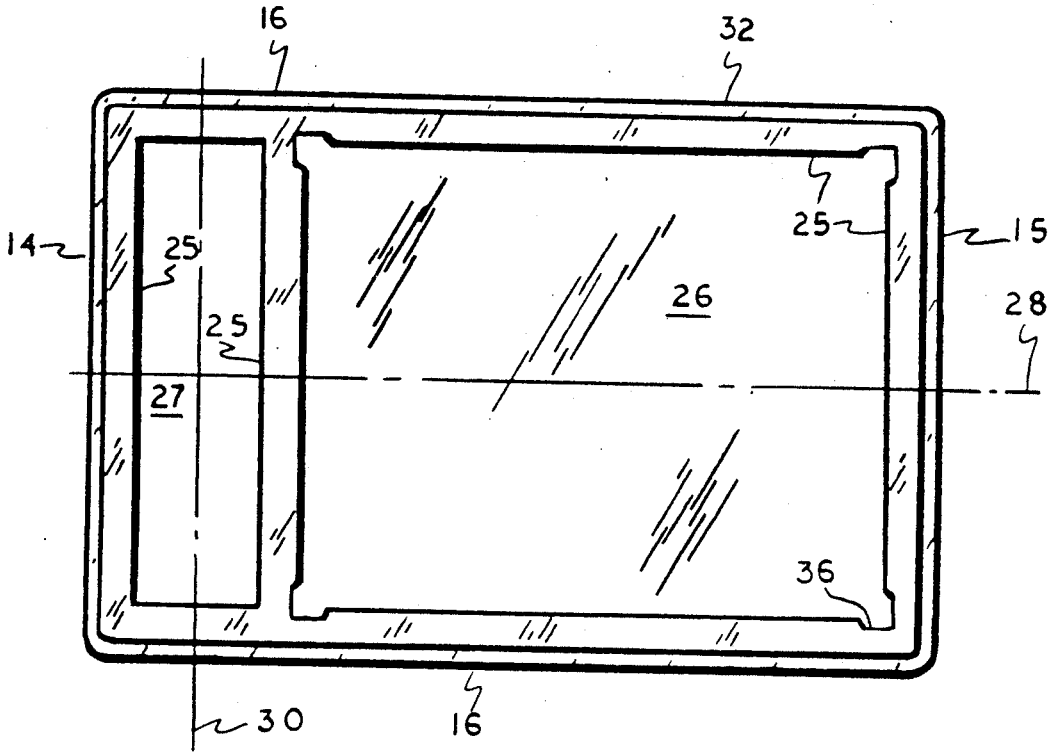
FIG. 5 is a plan view of the inside face of the rear panel component of the case of FIG. 1.
Figure 6:
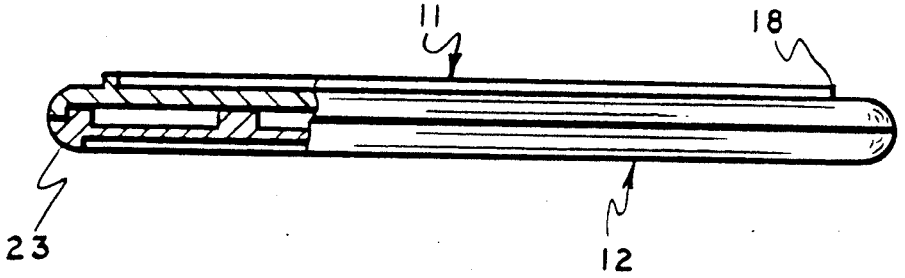
FIG. 6 is a side view of the case of FIG. 1 shown partly in section.

Referring to FIGS. 1–6, an embodiment of the case 10 of the present invention is shown comprised of front panel 11 and rear panel 12 which sandwich therebetween transparent retainer 29 holding postage stamps 13, and documentation card 31.

Front panel 11 is fabricated of transparent plastic such as polyacrylate, polycarbonate and other resins having thermoplastic characteristics. The panels may be fabricated from suitable resins by molding, stamping or equivalent shaping methods. Panel 11 has an elongated rectangular perimeter defined by upper and lower short edges 14 and 15, respectively, and long side edges 16, all of said edges being rounded. The outer face 17 of panel 11 has a first upraised ridge 18 of rectangular contour disposed adjacent said perimeter and uniformly spaced therefrom by margin region 19. The interior face 20 of panel 11 has an upraised lip 21 formed as a continuous integral extension of said edges and directed in opposite relationship to ridge 18.

Rear panel 12 is fabricated of the same plastic material as front panel 11, and is also identical in its rectangular perimeter. The outer face 22 of panel 12 has a second upraised ridge 23 contiguous to said perimeter and of a rectangular contour slightly larger than the rectangular contour of first upraised ridge 18. The interior face 24 of panel 12 has upraised portions in the form of flat and straight shoulders 25 uniformly spaced from said edges by margin region 32 and defining first rectangular holding zone 26 and second holding zone 27. Zone 26 has an axis of elongation 28 which is perpendicular to short edges 14 and 15, and is adapted to confine postage stamps 13 while permitting slight movement thereof between shoulders 25. Arrow-shaped venting recesses 36 are positioned at each corner of zone 26. Retainer means 29, comprised of two rectangular sheets of semi-rigid plastic 34 joined at one edge by intervening strip 35, is disposed within holding zone 26 in close-fitting relationship therein. The retainer means embraces the stamp or other thin, flat collectible item in sandwich-like configuration. By virtue of such manner of retention, the collectible item can be safely handled en route to encasement, and will not be blown out of the case during the bonding operation.

Second holding zone 27, adapted to hold documentation card 31, is located adjacent upper short edge 14 and has an axis of elongation 30 which is perpendicular to side edges 16. The documentation card may contain information such as the country or origin of a stamp, date of issue, a catalog number, and the name of the appraising or certifying company.

The front and rear panels are configured such that, when brought together with the interior faces in facing juxtaposition, lip 21 of the front panel abuts against margin region 32 of said rear panel. At said site of abutment which is essentially the perimeter of the case, cohesive interbonding of the panels can be achieved. Such interbonding involves the use of ultrasonic or microwave energy which causes the abutting surfaces to establish secure bonding, generally by fusion at the microscopic level. Such bonding therefore does not involve the use of solvents or glues which may introduce harmful levels of contaminants into the sealed case. Equipment for achieving such bonding or welding of plastic is well known. Any gases generated by the melting of the plastic are forced out of the case, aided by venting recesses 36, before sealing. In order to further ensure the archival storage stability of the encased sports cards, the welding or sealing operation may be conducted in a blanketing environment of an inert gas such as dry nitrogen, helium and the like.

The preferred interbonding involves a two stage sealing achieved by ultrasonic techniques and referred to as shear joint welding. In the first stage, partial melting and consequent welding is achieved, allowing gases generated by the melting to exit from the corners of the case. In the second stage, the corners are welded to complete the sealing operation.

The dimensions of holding zone 26 are such that an encased flat item held by retainer means 29 is not pressed tightly against the plastic sheets 34 of said retainer means. The height of shoulders 25 and their spacing may be varied in different embodiments to properly accommodate collectible items and corresponding retainer means of matching dimensions.

When two or more of the cases are stacked so that all front and rear panels are identically oriented, the second upraised ridge 23 of rear panel 12 will seat upon margin region 19 of the front panel of the next underlying case. Such seating relationship provides lateral stability to any stack of the cases. In preferred embodiments, ridge 23 and margin region 19 will have a roughened texture which further promotes interlocking of the stacked cases.

The cases are amenable to reviewable display in collection form in sleeves and other holder devices that may be held together by binder devices.

The expressions "front" and "rear" have been used for ease of description in reference to panels 11 and 12, respectively. However, it is to be noted that in the assembled case there is little distinction between said panels. Said panels might therefore alternatively be denoted by the expressions "first" and "second" or equivalents thereof.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A case for protectively confining collectible flat items, comprised of:

(a) a first panel fabricated of transparent plastic and having: (1) an elongated rectangular perimeter defined by upper and lower short edges and long side edges, (2) an outer face having a first upraised ridge of rectangular contour disposed adjacent said perimeter and uniformly spaced therefrom by a margin region, and (3) an interior face having an upraised lip formed as a continuous integral extension of said edges and directed in opposite relationship to said first ridge, and (b) a second panel fabricated of transparent plastic and having: (1) an elongated rectangular perimeter identical to the perimeter of said first panel and defined by upper and lower short edges and long side edges, (2) an outer face having a second upraised ridge contiguous to said perimeter and of a rectangular contour slightly larger than the rectangular contour of said first upraised ridge, and (3) an interior face having upraised portions uniformly spaced from said edges and defining a first rectangular holding zone for accommodating a flat collectible item and having an axis of elongation perpendicular to said short edges, and a second holding zone adjacent said upper short edge, and (c) thin transparent retainer means removably disposed within said first holding zone, whereby (d) when the interior faces of the front and rear panels are brought into facing relationship, the upraised lip of said front panel snugly embraces the upraised portions of said rear panel, and permits cohesive interbonding of the edges of both panels.

2. The case of claim 1 wherein said second rectangular holding zone has an axis of elongation perpendicular to said side edges.

3. The case of claim 1 wherein the corners of said first holding zone are recessed outwardly from the holding zone.

4. The case of claim 1 wherein the distance of separation of the interior faces of the interbonded panels and the dimensions of said first holding zone are such as to avoid tight pressing contact of said retainer means upon said collectible item.

5. The case of claim 1 whereby, when two or more of the cases are stacked so that all first and second panels are uniformly oriented, said second upraised ridge will seat upon said margin region of the next underlying case, thereby imparting lateral stability to the stack of cases.

6. The case of claim 5 wherein said second upraised ridge and margin region have a roughened texture which further promotes interlocking of the cases.

7. The case of claim 1 containing a flat collectible item and a documentation card and cohesively sealed about said rectangular perimeter.

8. The case of claim 7 which encloses a minimal amount of gaseous material deleterious to said flat collectible item.

9. The case of claim 1 wherein said retainer means is comprised of two sheets of transparent semi-rigid plastic in stacked juxtaposition and joined by an interventing strip of transparent material.

10. The case claim 9 wherein the sheets of said retainer means are rectangular and are joined at one edge by said interventing strip.

* * * * *